United States Patent [19]

Allen

[11] Patent Number: 4,570,829

[45] Date of Patent: Feb. 18, 1986

[54] TOOTHPASTE DISPENSER

[76] Inventor: Kenneth M. Allen, P.O. Box 1602, Quincy, Calif. 95971

[21] Appl. No.: 523,353

[22] Filed: Aug. 15, 1983

[51] Int. Cl.[4] ..... B67D 5/06; F16L 55/14

[52] U.S. Cl. ..... 222/181; 222/78; 222/207; 222/214; 222/505; 251/6; 251/9

[58] Field of Search ..... 251/4, 6, 9; 222/92, 222/95, 96, 105, 107, 180, 181, 185, 206, 207, 209, 212–215, 372, 380, 383, 476, 505, 173

[56] References Cited

U.S. PATENT DOCUMENTS

| | | | |
|---|---|---|---|
| 2,113,022 | 4/1938 | Hefti | 222/214 X |
| 2,792,856 | 5/1957 | Coppage | 222/380 X |
| 3,066,832 | 12/1962 | Rossetti | 222/207 |
| 3,216,198 | 11/1965 | Brooks | 222/215 X |
| 3,217,933 | 11/1965 | Watson, Jr. | 222/96 |
| 3,220,611 | 11/1965 | Zander et al. | 222/95 |
| 3,473,779 | 10/1969 | Gustafson et al. | 251/9 |

FOREIGN PATENT DOCUMENTS

| | | | |
|---|---|---|---|
| 263467 | 9/1965 | Australia | 222/505 |

*Primary Examiner*—Joseph J. Rolla
*Assistant Examiner*—Michael S. Huppert
*Attorney, Agent, or Firm*—Harvey B. Jacobson

[57] ABSTRACT

A toothpaste dispenser is constructed in the form of a wall unit simulating a toothbrush with an elongate upper compartment for receiving an inverted toothpaste tube and constituting the toothbrush handle portion, and a lower compartment constituting the bristle portion of the toothbrush and containing a dispenser mechanism. The dispenser mechanism comprises a resilient dispensing duct which receives toothpaste from the inverted tube, and a lever-operated plunger for pumping paste through the tube and discharging same through an outlet nozzle. A metered quantity of paste is dispensed with each forward stroke of the lever.

9 Claims, 12 Drawing Figures

44
40
42
26
18
14
20
22
10
16
4
30
74
31
46
110
84
24
108
82
78
112
28
47
6
6
106
50
77
104
64
72
7
7
60
102
48
18
92
96
34
36
35
38
54
80
56
66
32
52
62
58
4

30
14
26
31
46
47
49
110
84
24
77
82
78
76
72
86
88
28
94
96
87
89
80
52
56
54

16
40
14
42
44

60
64
50

TOOTHPASTE DISPENSER

BACKGROUND OF THE INVENTION

The invention relates to a dispenser for toothpaste and like viscous substances contained in tubes, and referred to hereinafter generally as toothpaste. More particularly, the invention provides a toothpaste dispenser operated by a hand lever to dispense, with each operation of the lever, a metered quantity of paste (e.g. a sufficient quantity to cover a toothbrush) from a standard toothpaste tube or the like.

In a preferred form of the invention, the dispenser is integrated in a portable wall unit adapted to receive standard toothpaste tubes, so that the unit may be installed in a convenient location in a bathroom and the like, and be readily dismantled when a tube is empty, so that a fresh tube can be fitted. The wall unit may be constructed to simulate a toothbrush.

DESCRIPTION OF THE PRIOR ART

Acknowledgment is made of the following U.S. patents pertaining to fluid dispensers:

U.S. Pat. No. 3,006,832; Dec. 4, 1962
U.S. Pat. No. 4,256,242; Mar. 17, 1981
U.S. Pat. No. 4,349,133; Sept. 14, 1982
U.S. Pat. No. 4,350,268; Sept. 20, 1982

SUMMARY OF THE INVENTION

A toothpaste dispenser in accordance with one aspect of the invention comprises a dispensing duct of compressible resilient material, preferably a high-memory plastic, having an inlet end adapted to attach to the neck of a standard toothpaste tube and an outlet end through which paste is dispensed, a lever-operated plunger means for compressing the dispensing duct responsive to movement of the lever in one direction and releasing the duct responsive to movement of the lever in the reverse direction, and valve means internally of the duct preventing flow of paste other than through the outlet end when the tube is compressed, and preventing flow of paste through the outlet end while allowing paste to be received from the toothpaste tube through the inlet end when the duct is released. The dispenser operates with a pumping action, dispensing a charge of paste when the duct is compressed and drawing in a fresh charge of paste into the duct by suction when it is released and expands to its uncompressed normal cross-section. The length of the dispensing duct which is compressed is a factor in governing the quantity of paste dispensed with each stroke of the plunger.

The dispenser may preferably be integrated into a conveniently formed portable unit having an elongate compartment adapted to receive an inverted toothpaste tube, and a dispenser compartment at the base of the elongate compartment in which is housed the dispensing duct, the plunger, and the remainder of the dispenser mechanism, with the operating lever projecting through a slot in the top of the dispenser compartment. The unit may be formed to simulate a toothbrush with the elongate compartment constituting the toothbrush handle portion, and the dispenser compartment constituting the toothbrush bristle portion.

Further features of the invention include, for example, the provision of spring loaded pivotal pressure doors which apply lateral pressure to the dispensing duct when it is released by the plunger, to promote and assist in reversion of the duct to its normal cross-section, thereby enhancing the pumping action of the dispenser, and a sliding cap for the outlet of the dispensing duct, the cap being operated by the lever so as to open the outlet on pumping strokes of the plunger and slide over the outlet when the lever is released in a manner slicing off paste which has been dispensed.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
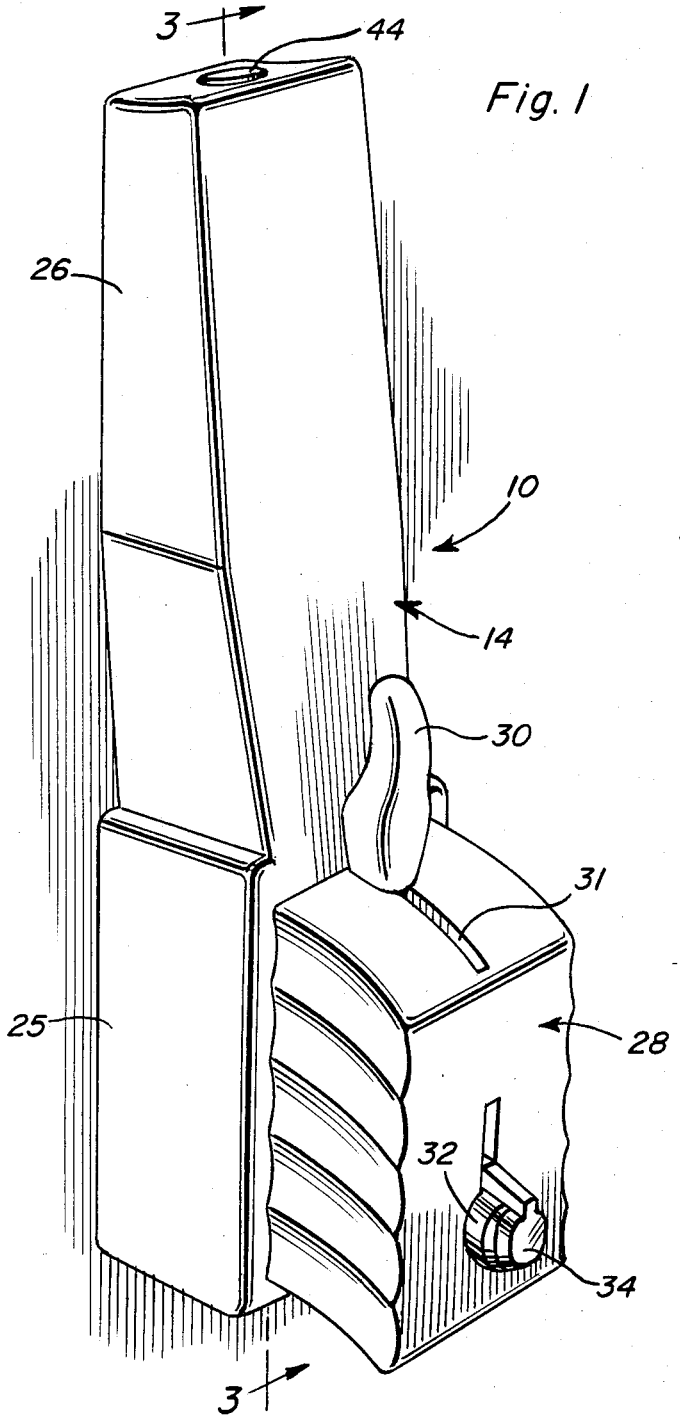
FIG. 1 is a perspective view of a toothpaste dispenser in accordance with the invention.
Figure 2:
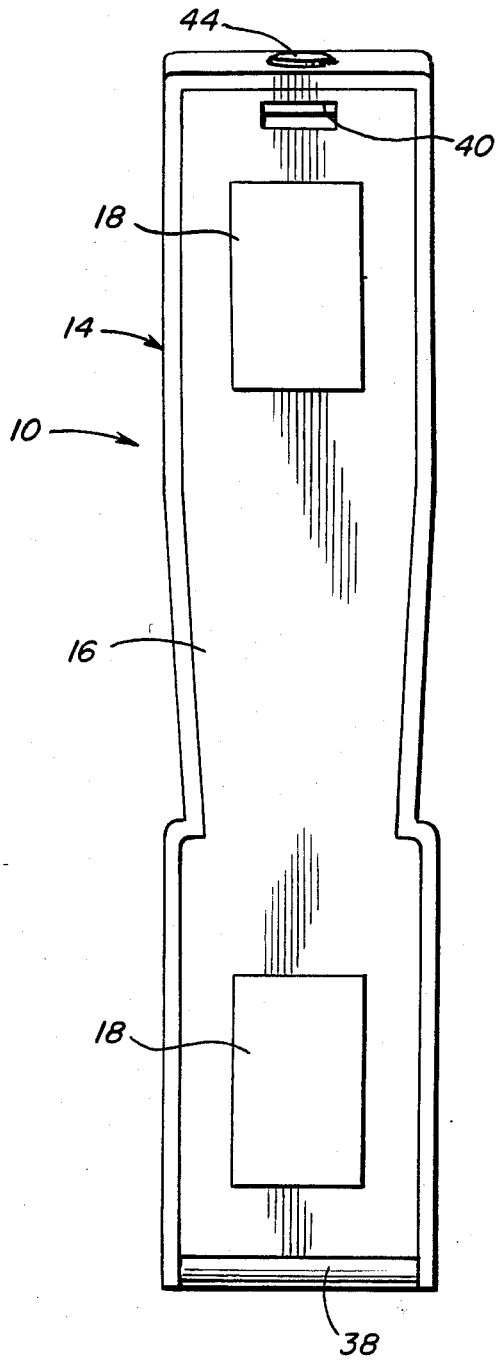
FIG. 2 is a rear elevational view of the dispenser.
Figure 3:
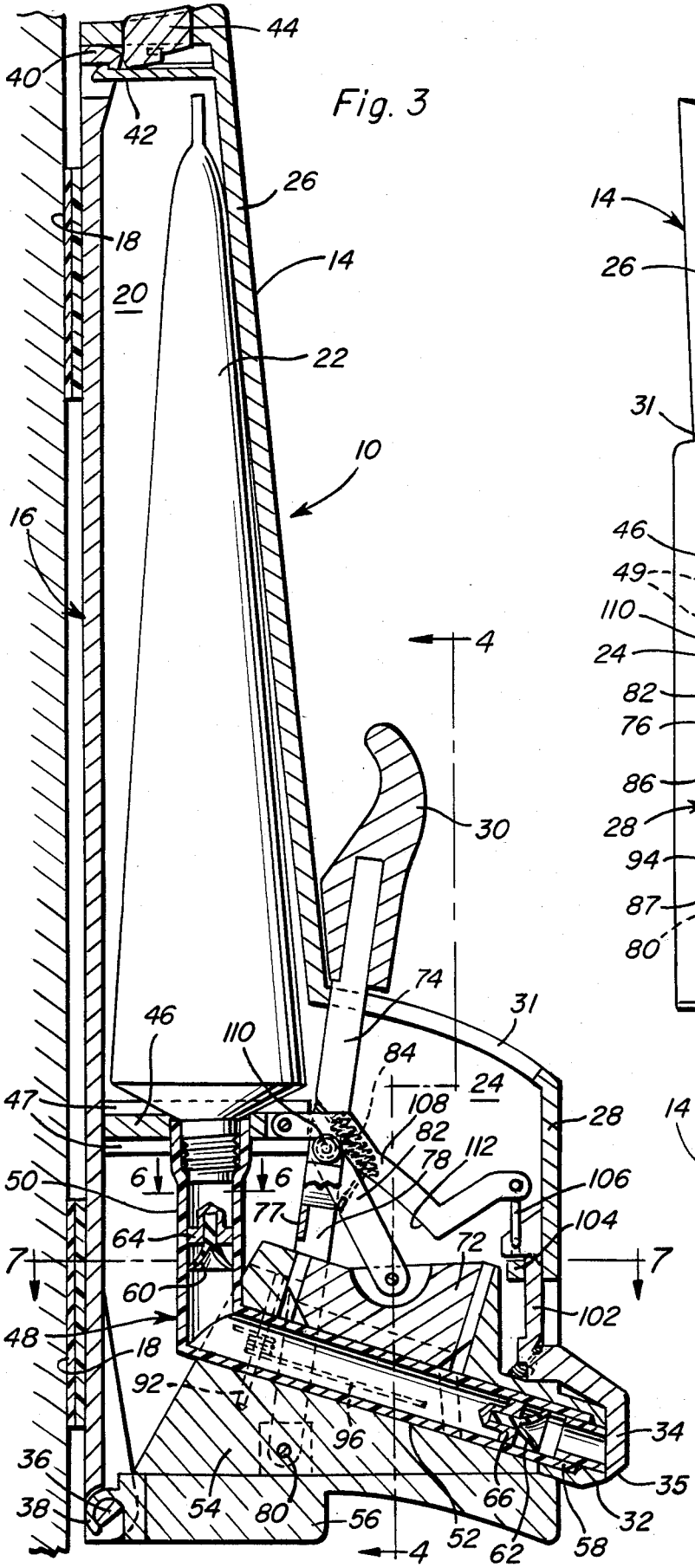
FIG. 3 is a sectional view on line 3—3 of FIG. 1.

As shown particularly in FIGS. 1 and 2, the invention provides a toothpaste dispenser 10 in the form of a wall unit simulative of a toothbrush. The unit comprises a front casing 14 which interfits with a rear panel 16 as will be described, both of which may be molded in lightweight plastic. The rear panel may be provided with self-adhesive tabs 18 or the like, for securing the unit on a bathroom or like wall. Internally, the casing defines an upper elongate compartment 20 (see FIG. 3) for a standard size toothpaste tube 22, and a lower compartment 24 containing the dispenser operating mechanism. The upper compartment 20 is defined by a part of the casing 26 simulating the toothbrush handle portion, and the lower compartment is defined by a part of the casing 28 defining the toothbrush bristle portion. A handle 30 of a operating lever extends from a slot 31 in the top wall of casing part 28, and an outlet nozzle 32 covered by a sliding cap 34 is provided in the front wall of casing part 28. When the lever is pulled down, cap 34 is raised and a metered amount of toothpaste from tube 22 is dispensed through the nozzle. When the lever is released, it is returned automatically to the position shown in FIGS. 1 and 3, and the cap 34 is lowered thereby slicing off the paste which has been dispensed.

In order to replace used toothpaste tubes, casing 14 may be detached from the rear panel 16. To this end, the casing and rear panel have a hinge connection at the bottom of the unit defined by a bar 36 on the panel and a mating journal 38 on the casing, while at the top of the unit rear panel 16 has a jaw 40 which mates with a resilient snap-in jaw 42 formed internally of the casing. A pushbutton 44 in the top wall of the casing releases the jaws.

Within compartment 24, casing 14 carries a mounting plate 46 with an opening receiving the upper inlet end of a disposable resilient dispensing duct 48 of inexpensive high-memory plastic, for example, the duct having a vertical upper portion 50 and an angled lower portion 52. The diameter of the duct is such that it can receive the threaded neck of a standard toothpaste tube. In use, tube 22 is thus threaded into the upper end of duct 48 and the weight of the tube is supported by plate 46. Plate 46 may be suitably secured in slotted bearings 47, 49 or the like in opposite sidewalls 23, 25 of compartment 24. The angled lower portion 52 of duct 48 is held in a support block 54 on base 56 of the casing and the outlet end 58 of the duct is received in outlet nozzle 32. Internally, duct 58 includes a pair of diaphragm-type one-way check valves 60, 62 in spiders 64, 66, the valves each being oriented to allow fluid flow through the duct in the direction toward the outlet nozzle, but preventing flow through the duct in the reverse direction.

Figure 8:
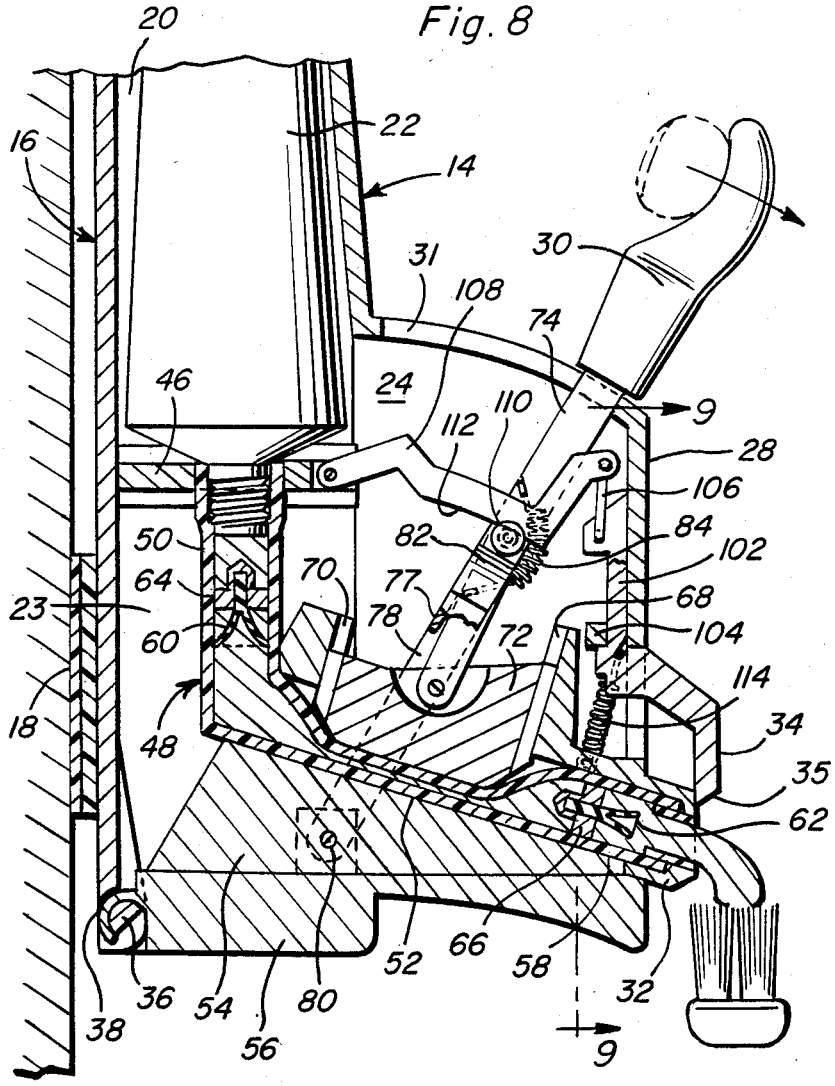
FIG. 8 is a sectional view, similar to FIG. 3, of the lower part of the dispenser illustrating the operation thereof.
Figure 10:
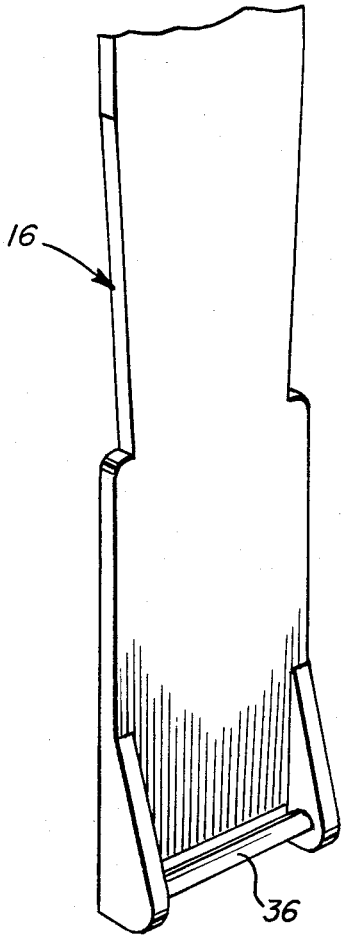
FIG. 10 is a perspective view of a lower portion of the rear panel of the dispenser.

Block 54 also provides front and rear guides 68, 70, (See FIG. 8) for a plunger 72 adapted to be moved up and down by a lever 74 (to which handle 30 is attached) so as to alternately compress and relax the duct 48 to provide a pumping action effective to dispense metered amounts of paste from tube 22 as will be described. Lever 74 has a pair of limbs 76, 78 which straddle block 54 and which are pivoted at the base of the block by a pivot pin 80. A link 82 is pivotally connected between the lever and plunger 72, so that when the lever is moved clockwise from the position shown in FIG. 3, to the position shown in FIG. 8, the plunger is depressed thereby compressing the angled portion 52 of duct 48. When the lever 74 is released, it returns to the initial position shown in FIG. 3 under the influence of a return spring 84 connected between lever 74 and link 82, thereby raising the plunger and allowing duct 48 to expand to its original cross-section. When duct 48 is compressed by the plunger, valve 62 allows paste within the duct to be forced through nozzle 32 while valve 60 prevents the paste from being forced back into the tube 22. When the plunger is raised and the duct expands to its original cross-section, thereby creating a vacuum within the duct, valve 60 allows paste from tube 22 to be drawn into the duct by suction, while valve 62 prevents outside air from being drawn into the duct. Thus, the plunger and duct provide a pumping action whereby a metered quantity of paste is dispensed with each downward stroke of the plunger. The quantity of paste dispensed is dependent on the length of the plunger and the plunger stroke. Thus, in practice, the plunger length and stroke (which may be controlled by the length of slot 31) are interrelated in order to provide metered dispensing of the required amount of toothpaste.

Figure 11:
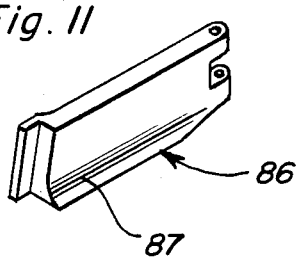
FIG. 11 is a perspective view of a pressure door.
Figure 12:
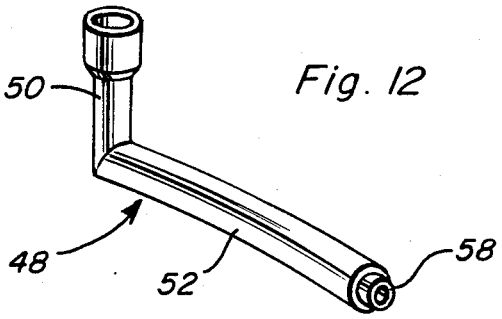
FIG. 12 is a perspective view of a resilient dispensing duct.
Figure 4:
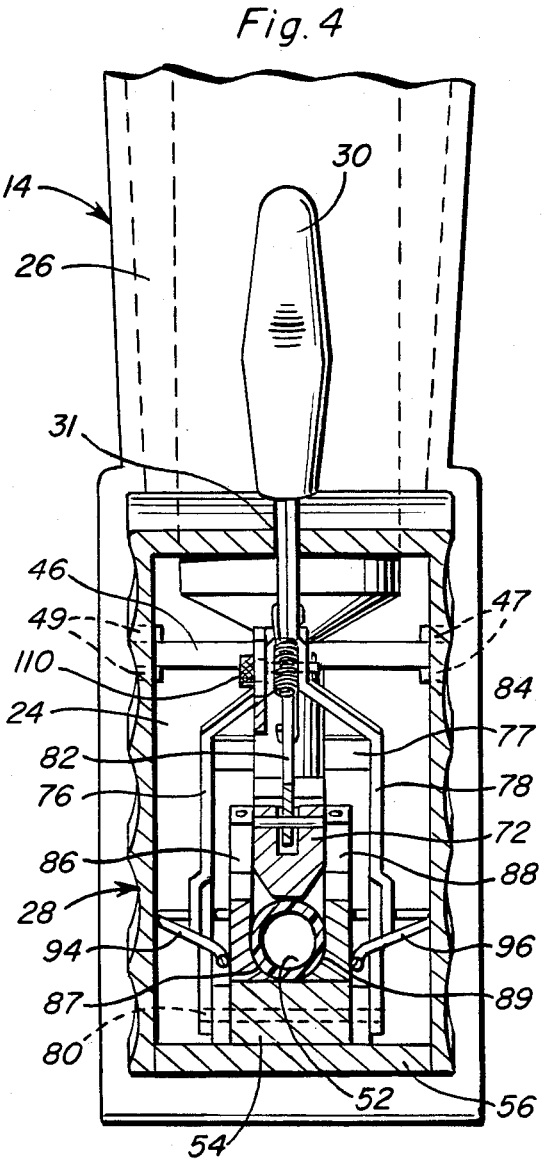
FIG. 4 is a sectional view on line 4—4 of FIG. 3.
Figure 5:
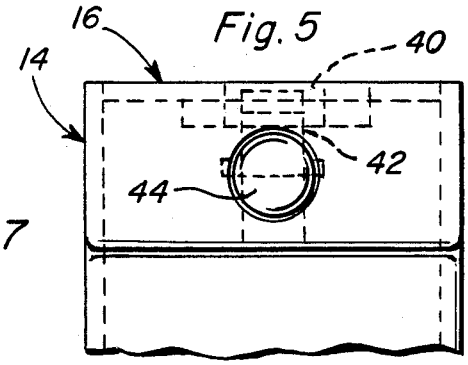
FIG. 5 is a partial plan view of the dispenser.
Figure 6:
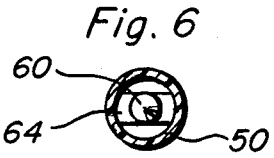
FIG. 6 is a sectional view on line 6—6 of FIG. 3.
Figure 7:
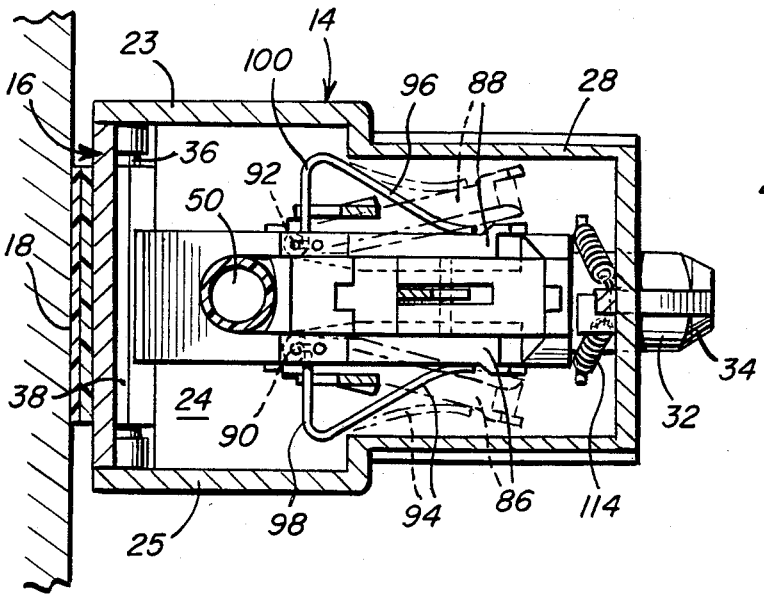
FIG. 7 is a sectional view on line 7—7 of FIG. 3.

In order to promote return of the duct to its original cross-section, when the plunger is raised, the apparatus includes a pair of pressure doors 86, 88 pivotally mounted on block 54 on opposite sides of angled portion 52 of duct 48, by means of pivot pins 90, 92. The doors have curved inner surfaces 87, 89 (FIGS. 4 and 11) which engage the duct, and the doors are urged inwardly by convergent spring arms 94, 96 of springs 98, 100 secured by the pivot pins (see FIGS. 4 and 7). When the plunger descends to compress the duct, spring arms 94, 96 are cammed outwardly by the limbs 76, 78 of lever 74 so that the doors offer substantially no resistance to lateral expansion of the duct. Then, when the lever is released and returned, thereby raising the plunger, the spring arms are released and urge the doors into engagement with the duct to squeeze it back into its original shape. A crossbar 77 is provided between limbs 76, 78 to support the limbs and prevent their bending inwardly.

Figure 9:
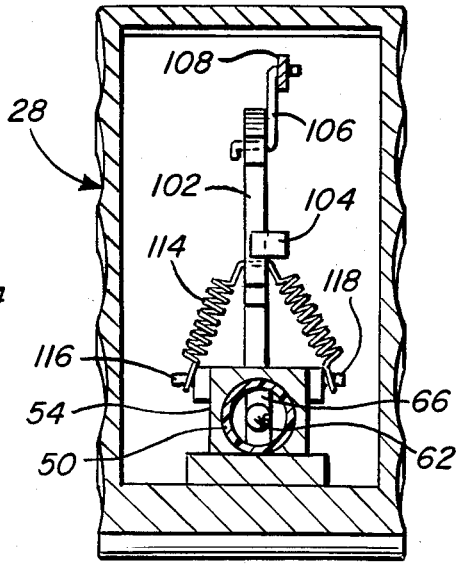
FIG. 9 is a sectional view on line 9—9 of FIG. 8.

The apparatus also includes a mechanism operated by lever 74 for raising and lowering cap 34. The cap is formed as a dependency from a slide 102 secured against the front wall of casing 28 by a bracket 104. A pivoted link 106 connects the slide to one end of a lever 108 pivoted at its opposite end to plate 46. Lever 74 carries a cam pin 110 disposed in engagement with a downwardly inclined cam surface 112 of lever 108 (see FIGS. 3 and 8). Thus, when lever 74 is operated to depress plunger 72, it also raises lever 108 thereby raising cap 34. The disposition of the cam surface 112 is such that cap 34 is raised before paste is dispensed from nozzle 32. A spring 114 is connected between slide 102 and pins 116, 118 associated with block 54 (see FIG. 9) so that when lever 74 returns to the FIG. 3 position, spring 114 lowers slide 102 and cap 34. The cap has a sharp bottom edge 35, and the cap slides over the face of nozzle 32. Thus, when the cap is lowered, it effectively slices of toothpaste which has been dispensed from that remaining in the apparatus.

Lever 74 may be operated repeatedly to dispense metered quantities of paste until tube 22 is empty. Then, the tube may be readily replaced by removing the casing of the unit from the rear panel. The unit may be configured to accept, medium or large size toothpaste tubes. The dispensing duct may also be readily removed and replaced if required.

Dispensers in accordance with the invention provide reliable and sanitary dispensing of toothpaste in an effective and economical manner. The sliding cap provides effective severing of the dispensed paste and the cap and nozzle surfaces allow for efficient cleaning away of paste by wiping with a toothbrush or the like. The dispensing duct is of a sanitary disposable design, and the apparatus can be adapted for use with diverse commercially available toothpaste tubes. The configuration of the dispenser lends itself to ready application and removal from a bathroom wall, and the device may be readily dismantled and reassembled when replacing toothpaste tubes. Effective positive-action metered dispensing is provided by the combination of the dispensing duct, plunger and pressure doors, and the entire apparatus may be incorporated in a unit which lends itself to production in an eye-catching esthetically pleasing simulation of a toothbrush article.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A dispenser for toothpaste and like viscous fluids comprising a dispensing duct of a resilient compressible material having an inlet and outlet, means for supporting a tube of toothpaste in inverted condition with the neck of the tube communicating with the inlet of said duct, means for manually compressing and then releasing portion of the duct, valve means within the duct for allowing toothpaste therein to be squeezed through the outlet when the duct is compressed while preventing toothpaste therein from being squeezed back into the toothpaste tube, and for allowing toothpaste from the tube to be drawn into the inlet by suction when the duct expands upon release of said portion thereof while preventing outside air from being drawn into the outlet, whereby operation of the compressing and releasing means provides a pumping action on the duct causing a metered quantity of toothpaste to be dispensed through the outlet each time the duct is compressed, wherein the compressing and releasing means comprises a plunger means engaging said portion of the duct, and means for manually depressing the plunger means to compress the duct and raising the plunger means to release the duct, the dispenser further including means for applying lateral pressure to the duct upon raising of the plunger means effective to restore the duct to its original cross-sectional form, thereby enhancing the creation of vacuum within the duct drawing in paste from said tube, wherein the lateral pressure applying means comprise pressure doors embracing opposite sides of the duct and spring means urging the doors to apply laterally inward pressure on the duct.

2. A dispenser as defined in claim 1 wherein the means for depressing the plunger means comprises a manually operable lever having a connection with the plunger means so as to depress the plunger means responsive to pivotal movements of the lever in one direction, the lever including means for relieving said doors of the pressure of said spring means when the plunger means is depressed so as to decrease the resistance to compression of said duct.

3. A dispenser as defined in claim 2 wherein the lever includes a pair of limbs interposed between the respective pressure doors and spring means for camming the spring means outwardly away from the doors responsive to movement of the lever depressing the plunger means.

4. A dispenser as defined in claim 3 including a return spring associated with the lever for returning the lever and plunger means to their initial positions after depression of the plunger means and release of the lever.

5. A dispenser as defined in claim 1 wherein the valve means comprises a pair of diaphragm-type check valves within the duct on opposite sides of the plunger means respectively.

6. A dispenser as defined in claim 1 wherein the outlet of the duct is associated with a discharge nozzle covered by a sliding cap, and linkage means is provided between the cap and the means for manually depressing the plunger means for raising the cap when the plunger means is depressed so as to uncover the nozzle and for lowering the cap when the plunger means is raised so as to cover the nozzle and sever the dispensed paste from paste remaining in the duct.

7. A dispenser as defined in claim 6 wherein the means for depress the plunger means comprises a manual operating lever and the linkage means comprises a link connected to the cap and defining a cam surface, the operating lever including a cam adapted to act on said cam surface to move said link in a manner raising the cap when the operating lever is moved to depress the plunger means.

8. A dispenser for toothpaste and like viscous fluids comprising a casing including duct means having an inlet for connecting to a fluid container and an outlet, a nozzle in a wall of the casing connected to the outlet of the duct means, manually operable pump means for effecting flow of fluid from the container through the duct means and nozzle, the pump means including a reciprocatory operating lever extending from the casing, a sliding cap covering said nozzle, and linkage means connected between the cap and said lever for moving the cap in the direction uncovering the nozzle and allowing discharge of fluid responsive to movement of the lever in one direction, and for moving the cap in a direction covering the nozzle and slicing off discharged fluid from fluid remaining in the duct means responsive to movement of the lever in the other direction, wherein the pump means includes a reciprocatory plunger operated by said lever for comprising and releasing the duct means to provide a pumping action responsive to forward and reverse strokes of said lever respectively, the lever being adapted to move the cap so as to uncover the nozzle on forward strokes thereof and to move the cap so as to cover the nozzle and slice off the discharge fluid on reverse strokes thereof, wherein the linkage means includes a pivotal link connected with the cap and formed with a cam surface, a cam on said lever adapted for camming said link in a direction moving the cap to uncover the nozzle responsive to forward strokes of the lever, and spring means for moving the cap to cover the nozzle responsive to reverse strokes of the lever.

9. The dispenser as defined in claim 8 included pivoted, springloaded pressure doors for exerting lateral pressure against opposite sides of the duct means when the duct means is released by the plunger means, the pressure doors effectively restoring the duct means to its uncompressed form thereby creating suction for drawing fluid into the duct means from the container.

* * * * *